United States Patent [19]

West et al.

[11] 4,331,080

[45] May 25, 1982

[54] COMPOSITE HIGH EXPLOSIVES FOR HIGH ENERGY BLAST APPLICATIONS

[75] Inventors: Martin M. West, Philadelphia; Peter D. Zavitsanos, Norristown, both of Pa.

[73] Assignee: General Electric Co., Philadelphia, Pa.

[21] Appl. No.: 157,901

[22] Filed: Jun. 9, 1980

[51] Int. Cl.[3] ..... F42D 1/00; C06B 25/34; C06B 43/00

[52] U.S. Cl. ..... 102/301; 149/22; 149/92; 149/93; 149/105; 102/364

[58] Field of Search ..... 149/22, 37, 105, 92, 149/93; 102/301, 364

[56] References Cited

U.S. PATENT DOCUMENTS

| | | | |
|---|---|---|---|
| 3,297,503 | 1/1967 | Hoffmann | 149/37 |
| 3,503,814 | 3/1970 | Helms et al. | 149/37 |
| 3,646,174 | 2/1972 | Macri | 149/22 |
| 3,690,849 | 9/1972 | Bredzs et al. | 149/22 |
| 3,695,951 | 10/1972 | Helms et al. | 149/37 |
| 3,896,909 | 10/1976 | Macri | 149/22 |
| 4,050,968 | 9/1977 | Goldhagen | 149/22 |

*Primary Examiner*—Edward A. Miller

*Attorney, Agent, or Firm*—Allen E. Amgott; Raymond H. Quist

[57] ABSTRACT

A novel composite explosive comprised of conventional explosive material and a mixture of boron and at least one other metal is disclosed. The other metal must be capable of exothermically reacting with boron to produce intermetallic compound and an energy release of at least about 1.0 kcal/gm. In a preferred embodiment of the composite explosive, pellets of a stoichiometric mixture of boron and titanium are mixed with cyclotetramethylenetetranitramine (HMX). By mixing the boron and at least one other metal which forms an intermetallic compound with boron in an exothermic reaction wherein the heat energy release is at least about 1.0 kcal/gm and adding a conventional explosive material to the mixture, there is an improved method of forming a mass of hot or molten particles in an environment when the conventional explosive is detonated.

28 Claims, No Drawings

COMPOSITE HIGH EXPLOSIVES FOR HIGH ENERGY BLAST APPLICATIONS

This invention relates generally to high explosive composites, and more particularly, to high explosive composites formed by mixing metals with conventional explosive substances.

Energy yields of high explosives ranging from trinitrotoluene (TNT) to cyclotetramethylenetetranitramine (HMX) are only about 1.0 to about 1.5 kilocalories per gram (kcal/gm). Secondary burning of these high explosives in air at elevated temperatures raises the volumetric energy release to a range of about 5.6 to about 6.1 kilocalories per cubic centimeter (kcal/cc). The addition of metals, such as aluminum, uranium or tungsten to high explosives has resulted in no significant improvement in energy yield or blast effectiveness. For example, in U.S. Pat. No. 3,111,439, it is disclosed that attempts have been made to increase the power of high explosives by incorporating therein finely divided aluminum, which serves to increase the amount of heat energy liberated during detonation. Upon detonation, these prior art aluminized explosives release energy in the form of heat of the order of 1.2 to 1.5 times the amount of energy released during the detonation of a similar quantity of TNT. However, the known explosives of this type are incapable of producing the maximum release of energy since sufficient quantities of aluminum are lacking, and thus portions of the available oxygen are expended on lower energy reactions.

To improve the foregoing disadvantages, and to improve the release of heat energy upon detonation by about 3 to 6.2 times the heat energy released upon the detonation of an equal weight of trinitrotoluene (TNT), one or more oxygen carriers and a metal, such as lithium, boron or beryllium, were added to high explosive compounds in U.S. Pat. No. 3,111,439. Heat is generated upon the formation of the oxides of the lithium, boron or beryllium. All of the oxygen of the carrier must be utilized in the formation of the metallic oxides to realize the improved generation of heat. However, oxygen carriers are undesirable and add to the bulk and weight of the explosive composition. Furthermore, the weight of the oxidizers dilute the explosive component by reducing the amount of explosive which can be incorporated in the explosive mass, i.e., the oxidizers occupy space which would preferably be occupied by explosives or other energy releasing components.

Improvements in afterburning and fireballing were discovered in U.S. Pat. No. 3,297,503 by adding certain thermites to high explosives, such as, cyclotol, a mixture of 60 parts of cyclotrimethylenetrinitramine (RDX) and 40 parts of trinitrotoluene (TNT). The thermites used in the improved prior art explosive of U.S. Pat. No. 3,297,503 include aluminum and iron oxide, zirconium and boron oxide, lithium and molybdenum oxide, lithium and tungsten oxide, aluminum and vanadium oxide, and aluminum and manganese oxide. The thermite process is based upon the reaction of various metallic oxides with a specified metal resulting in the oxidation of the metal to its oxide and the reduction of the metallic oxide to the free metal, the reaction being exothermic and oxygen self-sustaining. However, these prior art processes depend upon oxidative reactions and the oxygen of the metallic oxide to realize the resulting improvement in thermal energy. Even though the thermite process combined with high explosives in U.S. Pat. No. 3,297,503 results in improved fireballing, i.e., a phenomenon wherein the explosive rains down hot metal particles, maximum energy release is not achievable due to the fact that the explosive composition contains and depends upon oxygen self-sustaining ingredients, such as, the metallic oxides, the oxygen of which dilutes the mass required for the optimum exothermic capacity of the mixture. Most of the prior art compositions also release significant amounts of gases after detonation and thereby sustain substantial losses of energy in gas formation and gas dissipation. Furthermore, major emphasis continues for more efficient high explosives with higher energy yield per unit weight or volume.

Metals have also been added to blast gases in flame spraying processes to form intermetallic compounds and generate heat in situ in the actual material which is to form at least a part of the coating deposited upon a substrate by the flame spraying process. In U.S. Pat. No. 3,322,515, composite powders of metals which form intermetallic compounds, are sprayed into the flames of various flame-spray guns to form intermetallic compounds which deposit upon a base. The metals combine exothermically in the heat of the flame. U.S. Pat. No. 3,322,515 lists various conventional metal component pairs which may be formed into a composite powder, and which, when flame-sprayed, will exothermically react to form an intermetallic compound and a high grade coating. Examples of component pairs include boron and yttrium, boron and calcium, boron and chromium, boron and hafnium, boron and niobium, boron and tantalum, boron and thorium, boron and titanium, boron and vanadium, boron and tungsten and boron and zirconium. However, the disclosure in U.S. Pat. No. 3,322,515 relates only to the formation of conventional intermetallic compounds from metal powders in the flames of flame-spray guns.

Accordingly, it is the primary object of this invention to overcome the disadvantages of the prior art explosive compositions which incorporate metallic compounds to increase energy yields.

Another object of this invention is to provide more efficient high explosives with higher energy yield per unit weight or volume.

It is another object of this invention to provide a composition and method for increasing the energy release and blast effectiveness of high explosives and an improved method of forming a mass of hot particles in an environment.

Still another object of this invention is to provide an improved high explosive composition which utilizes boron and at least one other metal to increase energy yields substantially.

It is another object of this invention to provide a conventional explosive mass which incorporates non-gas-forming energy releasing components.

Another object of this invention is to provide metals in conventional explosive materials wherein the metals react to form substantially solids with the exothermic release of thermal energy.

These and other objects of the invention are achieved by providing a composite explosive comprising conventional explosive material and a mixture of at least two metals which form an intermetallic compound upon detonation of the conventional explosive. One of the metals in the mixture is boron, and the other metal or metals therein is a metal or metals which react with boron to yield an intermetallic compound, the reaction of the metals being accompanied by a substantial release of thermal energy, that is, at least about 1.0 kcal/gm.

There is disclosed a composite explosive comprised of conventional explosive material and a mixture of boron and at least one other metal, the at least one other metal being a metal or metals which are capable of exothermically reacting with boron to yield an intermetallic compound, the reaction of boron and the metal or metals being accompanied by a heat energy release of at least about 1.0 kcal/gm. The detonation of the conventional explosive material initiates the exothermic reaction of the boron and the other metal or metals.

In accordance with the present invention, the afterburning of metal in a conventional explosive material has been improved by adding the conventional explosive material to a mixture of boron and at least one other metal, the at least one other metal being a metal or metals which are capable of exothermically reacting with boron to yield an intermetallic compound, the reaction of boron and the metal or metals being accompanied by a substantial release of heat energy. As used herein, a substantial release of heat energy in defined as a heat energy of at least about 1.0 kcal/gm.

In accordance with the present invention, the conventional explosive material is detonated by any means well-known in the art. The explosion or ignition of the conventional explosive material causes the mixture of at least two metals to interact forming a hot or molten intermetallic metal compound. The hot and/or molten intermetallic compound forms a mass or cloud of hot or molten intermetallic particles in the area surrounding the explosion of the conventional explosive material, and the hot or molten intermetallic compound is carried or dispersed by the shock wave of the conventional explosive material. The scattering hot and/or molten intermetallic particles form a mass or cloud in the surrounding area or environment and release thermal energy. Thus, the thermal energy can be released at locations distant from the original event.

As used herein, the metal or metals which react with boron to yield an intermetallic compound, produce condensed phase products over time periods in the millisecond range and release energy, primarily as thermal energy of at least about 1.0 kcal/gm. The hot or molten intermetallic particles produced from the interaction of boron and at least one other metal, the intermetallic reaction being triggered or initiated by the explosive process of the conventional explosive material, generally have a temperature of about 3,000°–4,000° K.

As used herein, reaction, interaction and melting together are used interchangeably to define the exothermic reaction of the boron and other metal or metals regardless of the mechanism by which the mixture of metals exothermically combine to form intermetallic compounds.

In accordance with the present invention, the composite explosive embraces the destructive properties of the conventional explosive material and the thermal properties of the intermetallic particles. The improved composite explosive combines the incendiary properties of the reaction which forms the intermetallic compounds, with the explosive and/or fragmenting of the conventional explosive material. The composite explosive of the present invention provides a method of managing the deposition of thermal energy to targets by conveying hot or molten particles, having substantial amounts of thermal energy therein, to the target. In accordance with the improvements of the present invention, substantially no energy in the reaction or interaction of the metals in the exothermic formation of the intermetallic compound is lost in the form of gases, and substantially all of the energy in the formation of the intermetallic compound (at least 1.0 kcal/gm) is released as thermal energy. It is this thermal energy which is transferred to the environment including a target or target areas.

These and various other objects, features and advantages of the invention can be best understood from the following detailed description.

Any conventional high explosive material may be used in accordance with the present invention. The conventional high explosive compositions are generally described as single chemical explosives or mixtures of single chemical explosives. Preferred high explosives are those having energy yields ranging from that of trinitrotoluene (TNT) to cyclotetramethylenetetranitramine (HMX). Exemplary of such single chemical explosives embraced in the preferred embodiments of the present invention are nitroaminoguanidine (NAG), nitrosoguanidine, dinitrotoluene, nitrocellulose, nitrostarch, cyclotrimethylenetrinitramine (RDX), erythritol tetranitrate, mannitol hexanitrate, trimethylenetrinitramine and pentaerythritol tetranitrate (PETN), as well as TNT and HMX described above. Examples of mixtures of single chemical explosives, such as, mixtures of the single chemical explosives discussed above, include cyclotols which are mixtures of RDX and TNT in ratios of 75/25, 70/30, 65/35 and 60/40 respectively, Pentolite which is a mixture of PETN and TNT, Amatol which is a mixture of TNT and ammonium nitrate, Amatex which is a mixture of RDX, TNT and ammonium nitrate, and the like. One skilled in the art can choose any appropriate conventional high explosive material such as those listed above.

Generally, at least about 30% by weight of the composite explosive is conventional explosive material. However, the amount of conventional explosive added to, i.e., coated upon or otherwise mixed with the aggregates (mixture) of metals, is generally that amount sufficient to initiate the exothermic reaction of the mixture and to disperse the particles of hot intermetallic compound. In preferred embodiments of the present invention, the amount of conventional high explosive material which is used in the composite explosive of the invention, is dependent upon the particular operation or use for the composite explosive, and one skilled in the art can easily determine the amount of conventional explosive material required for the composite explosive. One skilled in the art can adjust the ratio of the amount of the primary explosive, that is, the conventional high explosive material, with the secondary explosive, that is, the mixture of metals which react to form the intermetallic compound, depending upon the amount of incendiary, burning, melting and/or thermal energy activity desired to the explosion. Generally, when the amount of conventional high explosive is greater than about 70% by weight of the composite explosive, the effect of the interaction between the metals to form the intermetallic compound diminishes with a concomitent diminishing of thermal energy release. Since the conventional high explosive materials form gases upon detonation, the composite explosive of the present invention containing high concentrations of the conventional explosive material, e.g., greater than about 70% conventional high explosive material, will predominantly form gaseous materials upon detonation within time periods of about 5–10 microseconds, producing energy mostly manifested as a high pressure event. When the composite explosive of the present invention contains small concentrations of conventional high explosive material, for example, less than about 30% conventional explosive material, the detonation of the composite explosive produces primarily condensed phase products over time periods in the millisecond range, releasing energy primarily as thermal energy in the form of very hot or molten particles having a temperature of between about 3,000° and 4,000° K. Thus, the composite explosive material has less shock wave destructive property and is more in the nature of thermal or incendiary due to the exothermic reaction of the metals which result in the formation of the intermetallic compound. Thus, one skilled in the art can determine the appropriate ratio of conventional high explosive material to the mixture of metal or metals in the composite depending upon the amount of thermal energy required and the amount of shock wave required to distribute the hot or molten particles of intermetallic compound formed as the secondary explosive reaction which is initiated by the primary explosive reaction of the conventional explosive material. Since the conventional explosives substantially yield gases in time periods within about 5–10 microseconds, producing about 1 to about 1.2 kcal/gm energy mostly realized as a high pressure event, and since the interaction of the metals yield a condensed phase product (intermetallic compound) over a time period in the millisecond range releasing at least 1.0 kcal/gm energy primarily as thermal energy in the form of very hot or molten particles, the concentration of conventional high explosive required in the explosive composite of the present invention can be easily determined depending upon the particular blasting or explosive operation. The generally preferred range of conventional explosive material is about 30% to about 70% by weight of the composite explosive.

The explosive composition of the present invention is a composite of conventional explosive material and a mixture of boron and at least one other metal which forms an intermetallic compound with boron upon detonation of the conventional explosive. In preferred embodiments, the term composite is intended to designate a consolidated integral unit, and preferably, does not include a mere mixture of components which may be physically separated without any destruction of the structure. Thus, in the preferred embodiments, the composition does not generally include a simple mixture of individual components, but preferably embraces individual aggregates, such as granules or pellets, each of which contain the separate metal components which will react exothermically forming intermetallic compounds. For example, a pellet, granule or other entity, may contain a mixture of the boron and at least one other metal which reacts exothermically with boron to form an intermetallic compound, the granule, pellet, or other entity, being mixed with or encapsulated with the conventional explosive material, or alternatively, the pellet, granule or other entity of desired size and shape may contain a mixture of the metal components necessary to form the intermetallic compound, and the conventional explosive material is mixed with the pellets, granules or other entity. In the aggregates, e.g., the pellets, the metal components are united by compression, binders or by any other suitable means of forming aggregates. It is also within the scope of the present invention to form the composition in the form of powders, each grain of which contains an aggregate of the metal components which will react exothermically to form the intermetallic compound. The conventional explosive material is added to the intermetallic mixture. The size, shape, form and method of making the composite is not critical in the practice of the present invention, and any combinations and permutations of the various ingredients of the composition may be used to form the composite explosive composition of the present invention. As used herein, aggregate defines any granule, grain, pellet or other entity containing a mixture of the metal components, that is the boron and the other metal or metals.

The metal components which enter into the intermetallic reaction, or which form the intermetallic compound in accordance with the present invention, may be boron and any other metal or metals which interact with boron to form an intermetallic compound in an exothermic reaction with a heat energy release of at least about 1.0 kcal/gm. The metals are in a substantially pure form and preferably contain no oxides or other compounds. The interaction of the boron and at least one other metal yields an intermetallic compound in the form of hot and/or molten particles having a temperature of at least about 2,000° K. In the formation of the intermetallic compound, the boron and one or more metals interact, react or melt together with an exothermic release of energy. The heat created by the interaction, reaction or melting together of the boron and at least one other metal is held within the intermetallic compound formed by the interaction and is subsequently radiated into the environment, for example, a target or other substrate. It is this exothermic reaction and the heat released by the intermetallic compound created as a product of the reaction or interaction which forms hot and/or molten particles of an incendiary nature. Furthermore, the blast from the conventional explosive material propels or spreads the hot and/or molten particles into the environment in the area surrounding the explosion.

As used herein, boron is considered as a metal which reacts with, interacts with, or melts together with one or more other metals to form an intermetallic compound with an exothermic release of energy. Although any other metal or metals may be used with the boron to form the intermetallic compound, if the interaction, reaction or melting together has a heat energy release of at least about 1.0 kcal/gm, the preferred metals which may be used to form the intermetallic compounds used in the composite explosive composition of this invention are lithium, titanium, hafnium, zirconium, tantalum, uranium, and mixtures thereof. The only limitation is that there must be heat energy release of at least about 1.0 kcal/gm when the metal or metals react with boron, and there must be the formation of an intermetallic compound which bears the heat energy of the reaction, interaction, or melting together of the boron and the metal.

While the boron and the metal or metals which interact therewith to form the intermetallic compound, are preferably present in substantially stoichiometric proportions required for the formation of the intermetallic compound, it is, however, possible to have an excess of the boron or the one or more metals, provided the relative amounts are sufficient to release the quantities of heat indicated above in the formation of the intermetallic compound.

The preferred metals which react with boron to form intermetallic compounds in accordance with the present invention are set forth below. In the chemical equations, (s) designates a solid and (l) designates a liquid, i.e., a molten intermetallic compound.

$$Ti(s)+2B(s)=TiB_2(l)$$

$$Li(s)+B(s)=LiB(l)$$

$$Hf(s)+2B(s)=HfB_2(l)$$

$$Zr(s)+2B(s)=ZrB_2(l)$$

$$Ta(s)+2B(s)=TaB_2(s)$$

$$U(s)+4B(s)=UB_4(s)$$

As explained above, while the preferred intermetallic compounds are expressed above, other metal components can be used with boron which can interact in an exothermic reaction to form an intermetallic compound with the generation or release of heat energy of at least about 1.0 kcal/gm. Such metals may be used with boron in accordance with the present invention, the only requirement being that the metal is capable of forming the intermetallic compound upon the initiation of the explosion or shock of the conventional explosive material and that the intermetallic compounds formed therefrom liberate the required amount of heat which can be carried by the particles of intermetallic compound into the environment by the shock wave of the detonated conventional explosive material. As explained above, mixtures of metals, for example, titanium and zirconium, tantalum and hafnium, zirconium and tantalum, and any other combinations and permutations of the preferred metals with each other or with other metals which release the required amount of thermal energy, i.e., at least about 1.0 kcal/gm, in an exothermic reaction may be used in accordance with the present invention. It is also within the scope of the invention for one skilled in the art to obtain a suitable intermetallic compound from the interaction of boron with certain metal alloys, and as used herein, the term "metal" also embraces such metal alloys.

The explosive composite of the present invention can be compounded, mixed, and formulated in any well-known manner for making composite explosive compositions. Preferred composite explosive compositions were described above. In one of the preferred methods, fine particles of boron and one or more metals of fine particle size are mixed in the desired stoichiometric quantities. The particles or powders are mixed in a blender and are formed into pellets by means of pressure in a conventional pelletizing operation. The metals are preferably finely-divided powders in relatively pure form and are commercially available in sizes and purities suitable for the practice of this invention. Although the invention is not limited to particle size, the particle size of the boron preferably ranges from about 300 Å to about 600 Å. The metal or metals which are mixed with the boron are generally somewhat larger or coarser and preferably have a particle size ranging from about 0.03 to about 0.06 mm (an average particle size of about $4.5\times10^{+5}$ Å. The pelletized aggregate or mixture of boron and at least one other metal is preferably encapsulated by conventional techniques with the conventional explosive material, for example, by melting the conventional explosive and solidifying the melted material upon the aggregates of metals or by consolidating the conventional explosive mixed with the pelletized aggregate of metals.

High purity boron and other metals are preferred in the composition of the present invention. The greater the purity of the boron and the other metals, the greater the energy release from the exothermic reaction. Impurities in the boron and other metals promote side reactions and create stoichiometric imbalances which can result in less than the desired amount of heat energy from the formation of the intermetallic compound from the boron and other metal or metals. Furthermore, although the particle size is not critical, the larger the particle size of the boron and other metal or metals, the slower the intermetallic reaction which results in a slower release of thermal energy. As explained above, optimum results are generally obtained when the boron has a particle size ranging from 300–600 Å and when the other metal or metals have a particle size of about 0.03 to about 0.06 mm.

As discussed above, the conventional explosive material, e.g., TNT, RDX, PETN, HMX and the like, can be encapsulated upon the aggregates of metals by any conventional method, i.e., the conventional explosive can be slowly heated to a few degrees above its melting point, and the pelletized aggregates of boron and other metal or metals can be slowly added thereto and carefully mixed by an appropriate mixer. The resulting material is permitted to cool until solidification results.

In an alternative embodiment, the boron and other metal or metals may be blended or mixed in the desired quantities and formed into aggregates by compacting or briquetting, and then divided into smaller aggregates or granules and appropriately combined with the conventional explosive material and consolidated into a protective container.

Any conventional detonation or initiating means or device may be used to detonate or initiate the conventional explosive in the composite explosive of the present invention. Conventional detonation means include a standard tetryl booster and detonator, blasting caps, impact sensitive starters and the like.

The composite explosive formulations of the present invention comprising conventional explosives, e.g., TNT, RDX, PETN, and HMX with up to 70% by weight of intermetallic compounds such as the exothermic reaction products of lithium and boron, titanium and boron, zirconium and boron, tantalum and boron, hafnium and boron, and the like, increases significantly the total lethal energy yields over conventional high explosives. Total volumetric energy yields range from about 26.1 to 40.4 kilocalories per cubic centimeter. These yields are illustrated in greater detail in subsequent tables. High temperatures (3,000°–4,000° K.) are generated by the formation of the intermetallic compounds. The molten intermetallic compounds further reacts in air to provide additional energy release.

Consolidated and confined conventional high explosives mixed with, blended with, containing or otherwise forming a composite with aggregates, such as pelletized, finely-divided particles of boron and one or more metals which form intermetallic compounds, when explosively triggered or initiated, cause the following improvements.

(1) The high rate of pressure generation or shock induced by the conventional high explosives causes shock initiation of the boron and the metal or other metal compounds to form the intermetallic compounds. The initiation mechanism is thought to be one of temperature elevation to the autoignition temperature of the boron and the metal or other metals which form the intermetallic compounds by shock compression of the distended mixtures.

(2) The resulting implosion of the boron and the metal or other metals to form the intermetallic compounds causes outward moving pressure waves to reflect on the inward moving shock waves. The reflected waves, generally more intense, (greater magnitude and shorter time) than the original waves enhances the fireball effect of the molten intermetallic compounds causing molten metal droplets to react violently with the oxygen in the explosive reaction environment.

(3) Interaction with the ambient environment causes tertiary burning and cratering to occur resulting from the adiabatic reaction temperatures, at least 3,000° K., and generally within a range of 3,000°–4,000° K., and the high pressure shock generated. Confined composite high explosives when cast or consolidated to pressures ranging from 5,000 to 20,000 pounds per square inch with a column to diameter ratio of 2:1, provides detonation rates of 4–5 millimeters per microsecond. The sensitivity and stability of the composite high explosive is equivalent to the conventional high explosive used in the composite formulations.

Uses for composite high explosives made in accordance with the present invention depend upon the lethal energy forms desired, e.g., incendiary, hypersonic molten particles or blasts. Composite explosive selection and packaging depends upon the type of vehicle/weapon/target combination desired, and one skilled in the art can utilize the composite explosive composition of the present invention in accordance with the desired end use and result. Typical vehicles include strategic or tactical cruise missiles, torpedoes, and ordnance munitions which are basically weight and/or volume limited. Typical targets include rocks/soil deepened craters, ground structures, satellites and underwater structures, such as, ship or submarine hulls. In either case, the weight and/or size of the munitions warhead can be reduced at least 25%, providing a more efficient lethal energy/blast source.

Other uses for the composite explosive composition of the present invention include mining operations, excavating, construction, demolition, oil shale exploration, and the like. The composite explosive compositions of the present invention may be used for any application where a fragmenting and explosive blast is desired along with any incendiary or thermal release.

In accordance with the present invention, there has also been described a method of forming a mass of hot or molten metal particles in an environment, comprising: (a) mixing boron and at least one other metal which forms an intermetallic compound with boron in an exothermic reaction having a heat energy release of at least about 1.0 kcal/gm; (b) adding a conventional explosive material to the mixture of boron and at least one other metal; and, (c) detonating the conventional explosive with suitable detonating means. The exothermic reaction of the mixture of boron and at least one other metal is initiated by the detonation of the conventional explosive material to form particles of hot intermetallic compound which are dispersed by the shock wave of the detonated conventional explosive.

Examples of the energy released by conventional and composite high explosives are illustrated below. A typical example of the composite high explosive of the present invention was made by mixing amorphous boron having a particle size of about 400 Å and having a purity greater than 99% boron. The boron was mixed in a blender with titanium particles having a particle size of −325 mesh (0.045 mm. or $4.5\times10^{+5}$ Å). The mixture of boron and titanium was formed into pellets by the use of pressure in a pellet-making apparatus to form pellets about 30 microns of desirable size range. The pellets are encapsulated with a conventional high explosive material from a solution of 2,4,6-trinitrotoluene. The resulting composite explosive comprised 50% by weight trinitrotoluene (TNT) and 50% by weight titanium and boron. The titanium and boron in the composite explosive material were mixed in stoichiometric quantities and contained 21.6 grams of boron for every 47.9 grams of titanium. In the three tables set forth below, the energy release of conventional high explosives which may be used in the composite of the present invention, is compared with the energy release of boron and the various preferred metals useful in forming the intermetallic compounds in accordance with the present invention alone and in combination with each other. Table 1 illustrates the energy released by various conventional high explosives.

TABLE 1

ENERGY RELEASE OF VARIOUS CONVENTIONAL HIGH ENERGY EXPLOSIVES

| CONVENTIONAL HIGH EXPLOSIVE MATERIAL | DENSITY (g/cc) | ENERGY RELEASE IN CONDENSED PHASE (kcal/gm) | ENERGY RELEASE DUE TO SECONDARY BURNING (kcal/gm) | TOTAL ENERGY kcal/gm | TOTAL ENERGY kcal/cc |
|---|---|---|---|---|---|
| TNT $[C_6H_2CH_3(NO_2)_3]$ | 1.55 | 1.0 | 2.6 | 3.6 | 5.6 |
| RDX $(C_3H_6N_6O_6)$ | 1.82 | 1.3 | 2.7 | 3.0 | 5.9 |
| HMX $(C_4H_8N_8O_8)$ | 1.90 | 1.5 | 3.1 | 4.5 | 6.1 |
| PETN $(C_5H_8N_4O_{12})$ | 1.77 | 1.4 | 2.9 | 4.1 | 7.3 |

When the conventional high explosive materials in Table 1 are detonated, they have a total energy release which varies from about 3.0 to 4.5 kcal/gm, depending upon the particular conventional high explosive material used. The energy released in the reaction is primarily gaseous and is in the nature of a fragmenting and explosive reaction wherein a shock wave is released.

Table 2, below, illustrates the energy released during the reaction of various metals with boron to form intermetallic compounds without the conventional high energy explosive material.

TABLE 2

ENERGY RELEASE OF INTERMETALLIC REACTIONS

| INTERMETALLIC COMPOUND | DENSITY (g/cc) | ENERGY RELEASE IN CONDENSED PHASE (kcal/gm) | ENERGY RELEASE DUE TO SECONDARY BURNING (kcal/gm) | TOTAL ENERGY RELEASE kcal/gm | TOTAL ENERGY RELEASE kcal/cc |
|---|---|---|---|---|---|
| Li + B | 1.23 | 1.15 | 2.72 | 3.87 | 38.2 |
| Tl + 2B | 3.50 | 1.15 | 6.60 | 7.70 | 40.4 |
| Hf + 2B | 8.75 | 0.39 | 2.40 | 2.79 | 34.5 |
| Zr + 2B | 3.20 | 0.69 | 1.50 | 1.83 | 33.3 |
| Ta + 2B | 6.81 | 0.22 | 1.80 | 2.02 | 26.1 |
| U + 4B | 14.00 | 0.20 | 3.10 | 2.30 | 32.2 |

The intermetallic compounds in Table 2 have a total energy release ranging from about 1.83 to about 7.70 depending upon the particular metal reacted with boron. As indicated in Table 2, the reaction of boron and the particular metal and the total energy released therefrom is dependent upon the initiation of the reaction by sufficient temperature and the presence of oxygen. The energy released by the exothermic reaction in the formation of the intermetallic compound is thermal or heat energy and is manifested by the formation of hot and/or molten (liquid) intermetallic compound.

Table 3 illustrates the typical energy release of various composites of the present invention wherein 50% of a conventional explosive is used with 50% of the mixture of boron and another metal, the boron and the other metal being present in stoichiometric quantities. The typical method of manufacturing such composites was described above for a composite explosive composition made by encapsulating pellets of boron and titanium mixtures with TNT explosive.

TABLE 3

ENERGY RELEASE OF VARIOUS COMPOSITES OF THE PRESENT INVENTION

| COMPOSITE | TOTAL ENERGY RELEASE kcal/gm | TOTAL ENERGY RELEASE kcal/cc |
|---|---|---|
| 50% TNT + 50% Ti, 2B | 5.6 | 23.0 |
| 50% RDX + 50% Ti, 2B | 5.4 | 23.2 |
| 50% TNT + 50% Hf, 2B | 3.2 | 20.1 |
| 50% HMX + 50% U, 4B | 3.4 | 19.2 |
| 50% PETN + 50% U, 4B | 3.2 | 19.8 |

The total energy release for the composites set forth in Table 3 ranges from about 3.2 to about 5.6 kcal/gm, depending upon the various ingredients in the composite explosive. In conventional uses, the conventional explosive material, e.g., TNT, is detonated by a standard detonating device, such as a blasting cap, which in turn initiates the reaction between the boron and the other metal. In the composite explosive compositions of Table 3, the total energy release is a combination of explosive energy combined with the thermal energy from the formation of the intermetallic compound.

In accordance with the present invention, composite explosive compositions having a conventional explosive material in a mixture of boron and at least one other metal which forms an intermetallic compound with boron, has been described, and a method of improving the thermal energy release of metals in a conventional explosive material to an aggregate of boron and at least one other metal which forms an intermetallic compound with boron upon detonation of the conventional explosive, has been disclosed. The intense exothermic reaction of the boron and at least one other metal substantially improved the thermal energy release over the prior art metal compositions and thermite compositions used with conventional explosive materials. There is no energy loss from the exothermic reaction in the formation of the intermetallic compounds due to oxidation and reduction reactions and the formation of gases which normally accompany most of the prior art explosives. Thus, more efficient high explosives with higher energy yields per unit weight or volumes have been described.

While the invention has been described in detail with reference to certain specific embodiments, various changes and modifications which fall within the spirit of the invention and scope of the appended claims will become apparent to those skilled in the art. The invention, therefore, is intended only to be limited by the claims appended hereto.

What is claimed is:

1. A composite explosive comprised of conventional explosive material and a mixture of boron and at least one other metal, the at least one other metal being a metal or metals which are capable of exothermically reacting with the boron to yield an intermetallic compound, the reaction of boron and the metal or metals being accompanied by a heat energy release of at least about 1.0 kcal/gm.

2. A composite explosive according to claim 1, wherein the conventional explosive material is a single chemical explosive.

3. A conventional explosive according to claim 1 wherein the conventional explosive material is a mixture of single chemical explosives.

4. A composite explosive according to claim 1 wherein the conventional explosive material is selected from the group consisting of trinitrotoluene, cyclotrimethylenetrinitramine, pentaerythritol tetranitrate, cyclotetramethylenetetranitramine and mixtures thereof.

5. A composite explosive according to claim 1, wherein the other metal which forms an intermetallic compound with boron is selected from the group consisting of lithium, titanium, hafnium, zirconium, tantalum, uranium, and mixtures thereof.

6. A composite explosive according to claim 1, wherein the composite explosive is comprised of at least about 30% by weight of the conventional explosive material.

7. A composite explosive according to claim 1, wherein the mixture of boron and at least one other metal which forms an intermetallic compound with boron is pelletized.

8. A composite explosive according to claim 1, wherein the boron and at least one other metal are present in the mixture in substantially stoichiometric amounts.

9. A composite explosive comprised of conventional explosive material and a mixture of metals which form an intermetallic compound upon detonation of the conventional explosive material, the mixture of metals comprising boron and at least one other metal selected from the group consisting of lithium, titanium, hafnium, zirconium, tantalum, uranium and mixtures thereof.

10. The composite explosive according to claim 9, wherein the conventional explosive material is selected from the group consisting of trinitrotoluene, pentaerythritol tetranitrate, cyclotrimethylenetrinitramine, cyclotetramethylenetetranitramine and mixtures thereof.

11. The composite explosive according to claim 9, wherein the composite explosive comprises at least about 30% by weight of the conventional explosive material.

12. The composite explosive according to claim 9, wherein the boron and at least one other metal are present in the mixture in substantially stoichiometric amounts.

13. The composite explosive according to claim 9, wherein the mixture of metals which form an intermetallic compound, is formed into pellets.

14. A method of improving the thermal energy release of metal in a conventional explosive material comprising adding the conventional explosive material to a mixture of boron and at least one other metal, the at least one other metal being a metal or metals which are capable of exothermically reacting with boron to yield an intermetallic compound, the reaction of boron and the metal or metals being accompanied by a heat energy release of at least about 1.0 kcal/gm.

15. The method of claim 14, wherein the conventional explosive material is a single chemical explosive.

16. The method of claim 14, wherein the conventional explosive material is a mixture of single chemical explosives.

17. The method of claim 14, wherein the conventional explosive material is selected from the group consisting of trinitrotoluene, cyclotrimethylenetrinitramine, pentaerythritol tetranitrate, cyclotetramethylenetetranitramine and mixtures thereof.

18. The method of claim 14, wherein the other metal which forms an intermetallic compound with boron is selected from the group consisting of lithium, titanium, hafnium, zirconium, tantalum, uranium and mixtures thereof.

19. The method of claim 14, wherein at least about 30% by weight of the composite explosive is conventional explosive material.

20. The method of claim 14, further comprising forming aggregates of the mixture of boron and at least one other metal which forms an intermetallic compound with boron, and thereafter adding the conventional explosive material to the aggregates.

21. The method of claim 20, wherein the aggregates are pellets.

22. The method of claim 14, wherein substantially stoichiometric amounts of the at least one other metal are mixed with the boron.

23. A method of forming a mass of hot or molten particles in an environment, comprising:

(a) mixing boron and at least one other metal which forms an intermetallic compound with boron in an exothermic reaction wherein the heat energy release is at least about 1.0 kcal/gm;

(b) adding a conventional explosive material to the mixture of boron and at least one other metal; and, (c) detonating the conventional explosive with suitable detonating means, whereby the exothermic reaction of the mixture of boron and at least one other metal is initiated by the detonation of the conventional explosive material to form particles of hot intermetallic compound which are dissipated by the shock wave of the detonated conventional explosive.

24. The method according to claim 23, wherein the amount of conventional explosive material added to the mixture of boron and at least one other metal is that amount sufficient to initiate the exothermic reaction of the mixture and to disperse the particles of hot intermetallic compound.

25. The method according to claim 24, wherein the amount of conventional explosive material is at least about 30% by weight of the composite formed from the conventional explosive material and the mixture of boron and at least one other metal.

26. The method according to claim 23, further comprising forming aggregates of the boron and at least one other metal prior to adding the conventional explosive material thereto.

27. The method according to claim 23 wherein the at least one other metal is selected from the group consisting of lithium, titanium, hafnium, zirconium, tantalum, uranium, and mixtures thereof.

28. The method according to claim 23 wherein the conventional explosive material is selected from the group consisting of 2,4,6-trinitrotoluene, cyclotrimethylenetrinitramine, pentaerythritol tetranitrate, cyclotetramethylenetetranitramine and mixtures thereof.

* * * * *